US008007200B2

(12) United States Patent
Brockway

(10) Patent No.: US 8,007,200 B2
(45) Date of Patent: Aug. 30, 2011

(54) MODULAR AXLE GUARD FOR COMPACTOR WHEEL

(75) Inventor: Robert John Brockway, Scottsboro, AL (US)

(73) Assignee: Terra Compactor Wheel Corp., Scottsboro, AL (US)

( * ) Notice: Subject to any disclaimer, the term of this patent is extended or adjusted under 35 U.S.C. 154(b) by 128 days.

(21) Appl. No.: 12/619,981

(22) Filed: Nov. 17, 2009

(65) Prior Publication Data

US 2011/0116875 A1 May 19, 2011

(51) Int. Cl.
*E01C 19/26* (2006.01)

(52) U.S. Cl. ..... 404/124; 404/121; 172/817

(58) Field of Classification Search ..... 404/121, 404/124

See application file for complete search history.

(56) References Cited

U.S. PATENT DOCUMENTS 517,352 A * 3/1894 Maxwell ..... 404/121
3,071,050 A * 1/1963 Shatto ..... 404/124
3,823,983 A * 7/1974 Peterson ..... 301/43
4,195,695 A * 4/1980 Dixon ..... 172/1
5,330,260 A * 7/1994 Freeman ..... 305/110
5,687,799 A * 11/1997 Greenfield et al. ..... 172/540
5,769,507 A * 6/1998 Brockway ..... 301/43
5,967,242 A * 10/1999 Caron et al. ..... 172/817
6,991,401 B1 * 1/2006 Caron ..... 404/124
D615,563 S * 5/2010 Brockway ..... D15/28
2007/0280783 A1 12/2007 Gibbins

* cited by examiner

*Primary Examiner* — Raymond Addie
(74) *Attorney, Agent, or Firm* — Ziolkowski Patent Solutions Group, SC

(57) ABSTRACT

A compactor wheel is disclosed that includes a hub mountable to an axle of a compaction machine and a rim mounted around an outer circumference of the hub, with the rim having a wrapper and inner and outer circumferential edges. The compactor wheel also includes a modular axle guard positioned near the inner circumferential edge and extending outward from the wrapper, the modular axle guard having a plurality of guard modules arranged about an outer circumference of the rim. Each of the guard modules includes a pair of wedge segments affixed to the wrapper and positioned on the wrapper in a spaced apart relationship and a guard segment positioned on the wrapper and seated between the pair of wedge segments. The guard segment includes a portion that extends radially outward from the wrapper and beyond the pair of wedge segments.

22 Claims, 7 Drawing Sheets

MODULAR AXLE GUARD FOR COMPACTOR WHEEL

BACKGROUND OF THE INVENTION

The invention relates generally to compaction machines, such as those used to compact landfills and, more particularly, to compactor wheels on such a compaction machine having a modular axle guard system for guarding against refuse and debris wrapping around the axle of the compaction machine.

Compaction machines are used to compact landfill sites, garbage dumps and other such locations. These machines typically include a self-propelled vehicle having four large wheels made of steel. Each wheel has a hub mounted to one end of an axle and a rim disposed around and radially out from the hub. The rim typically includes an outer wrapper on which a plurality of cleats is usually mounted. One problem encountered by such machines is the accumulation of waste behind the compaction wheel. Waste materials such as steel cable, wire, rope and the like have a particularly detrimental effect. Such refuse tends to wrap around the axles of the compaction machine and become trapped between the wheel and its axle, increasing the corresponding frictional forces therebetween. Increasing the friction between the wheel and its axle increases the load on the wheel propulsion system (e.g., an internal combustion engine) and reduces the life of the compaction machine. In addition, such increased frictional forces can cause the compaction wheels to wear to the point of requiring repair or even replacement of the wheels. Such wear related repairs can be very costly, and replacement wheels are very expensive.

Previously, the only way to prevent the buildup of waste behind the wheels and the corresponding premature wear and tear on the compaction machine was to periodically remove each compaction wheel so that refuse trapped between the wheel and the axle can be removed. Removing the compaction wheels on a compaction machine is a labor intensive and time consuming process. Compaction wheels can have an outside diameter of up to 84 inches and weigh up to five tons per wheel. It can take up to three working days or more to remove, clean and inspect the wheels and axles of a typical compaction machine. Such down time can result in lost income from refuse left uncompacted. In addition, trash dumping sites typically do not have backup compaction machines available to take over during the down times. The operator of, for example, a landfill risks being charged federal and state fines for each day the trash at the site remains uncompacted.

More recently, axle guard systems have been included on compactor wheels to help prevent refuse and debris from wrapping around the axle of the compaction machine. Such axle guard systems are typically formed of a singular barrier that is formed about a rim of the compactor wheel, with the barrier being bolted or welded onto the wheel. While such an axle guard system performs to help prevent refuse and debris from wrapping around the axle of the compaction machine, the unitary barrier of the guard makes repair of the axle guard difficult. That is, it is recognized that portions of the axle guard may become worn over time and need replacement. For axle guard systems formed as a singular, unitary barrier, it is necessary to remove the entire axle guard from the compactor wheel, which can be costly and time consuming. Furthermore, axle guard systems formed as a singular, unitary barrier are typically composed of a single material, such as an abrasion resistant material able to withstand wear. Such material is expensive, and it would be desirable to use cheaper materials for formation of the axle guard system where possible.

It would therefore be desirable to have a system and method for providing an axle guard system that is modular in form, thus allowing for the selective removal of sections of the axle guard system as desired. It would furthermore be de desirable to have an axle guard system that is composed of multiple materials, so as to minimize materials costs in constructing the axle guard system and allow for offering of axle guard systems at different price levels.

BRIEF DESCRIPTION OF THE INVENTION

Embodiments of the invention provide a modular axle guard system for guarding against refuse and debris wrapping around the axle of a compaction machine.

In accordance with one aspect of the invention, a compactor wheel is provided that is mountable on an axle of a compaction machine. The compactor wheel includes a hub mountable to an axle of a compaction machine and a rim mounted around an outer circumference of the hub, with the rim having a wrapper, an inner circumferential edge, and an outer circumferential edge. The compactor wheel also includes a modular axle guard positioned near the inner circumferential edge and extending outward from the wrapper, with the modular axle guard having a plurality of guard modules arranged about an outer circumference of the rim. Each of the plurality of guard modules includes a pair of wedge segments affixed to the wrapper and positioned on the wrapper in a spaced apart relationship and a guard segment positioned on the wrapper and seated between the pair of wedge segments, with the guard segment including a portion that extends radially outward from the wrapper and beyond the pair of wedge segments.

In accordance with another aspect of the invention, a method is provided for attaching each of a plurality of guard modules to a compactor wheel that includes a rim having a wrapper, an inner circumferential edge, and an outer circumferential edge. The method includes the step of positioning a guard segment on the wrapper near to the inner circumferential edge of the rim and between an inner wedge segment and an outer wedge segment affixed on the wrapper and such that a first portion of the guard segment is seated between the inner wedge segment and the outer wedge segment and a second portion of the guard segment extends radially outward past the inner and outer wedge segments. The method also includes the step of affixing opposing edges of the second portion of the guard segment to the second portion of guard segments in adjacent guard modules.

In accordance with yet another aspect of the invention, a modular axle guard is provided that is formed about a rim of a compactor wheel. The modular axle guard includes a plurality of guard modules arranged circumferentially about the rim of the compactor wheel and in proximity to an inner edge thereof. Each of the plurality of guard modules includes a pair of wedge segments positioned on a wrapper of the rim in a spaced apart relationship to form a groove between the pair of wedge segments, with each of the pair of wedge segments having an abutment edge having a profile corresponding to a curvature of the wrapper. Each of the plurality of guard modules also includes a guard segment positioned on the wrapper and including a first portion positioned adjacent the rim and a second portion extending radially outward from the first portion, wherein the first portion is seated in the groove between the pair of wedge segments. Each of the plurality of guard modules further includes a first group of welds configured to affix the pair of wedge segments to the wrapper and a second group of welds configured to affix the second portion of the guard segment to the second portion of guard segments from adjacent guard modules.

Various other features and advantages will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION OF THE PREFERRED EMBODIMENT

Figure 1:
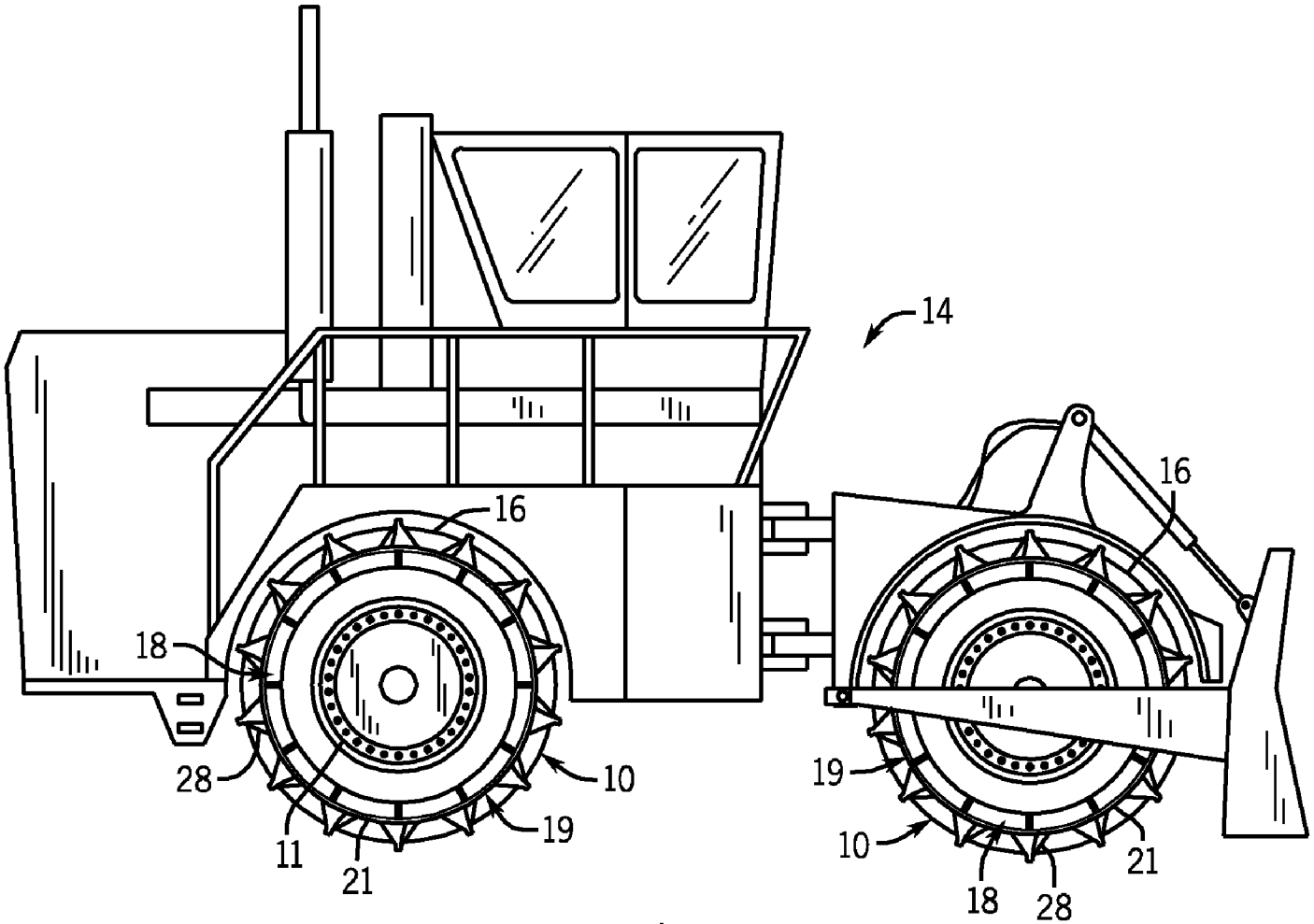
FIG. 1 is a side view of a compaction machine having compactor wheels mounted thereon for use with embodiments of the invention.
Figure 3:
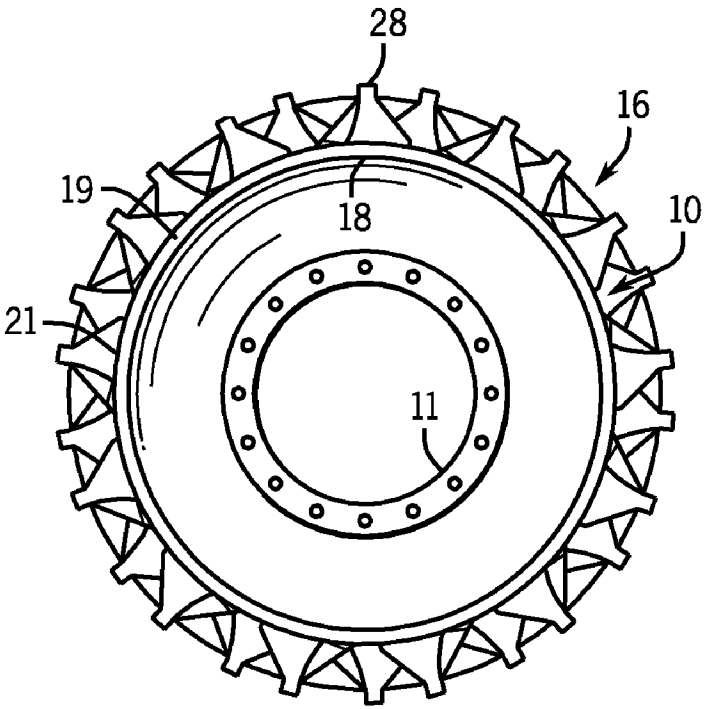
FIG. 3 is an outer edge view of the compactor wheel of FIG. 2 with the modular axle guard mounted thereon according to an embodiment of the invention.
Figure 2:
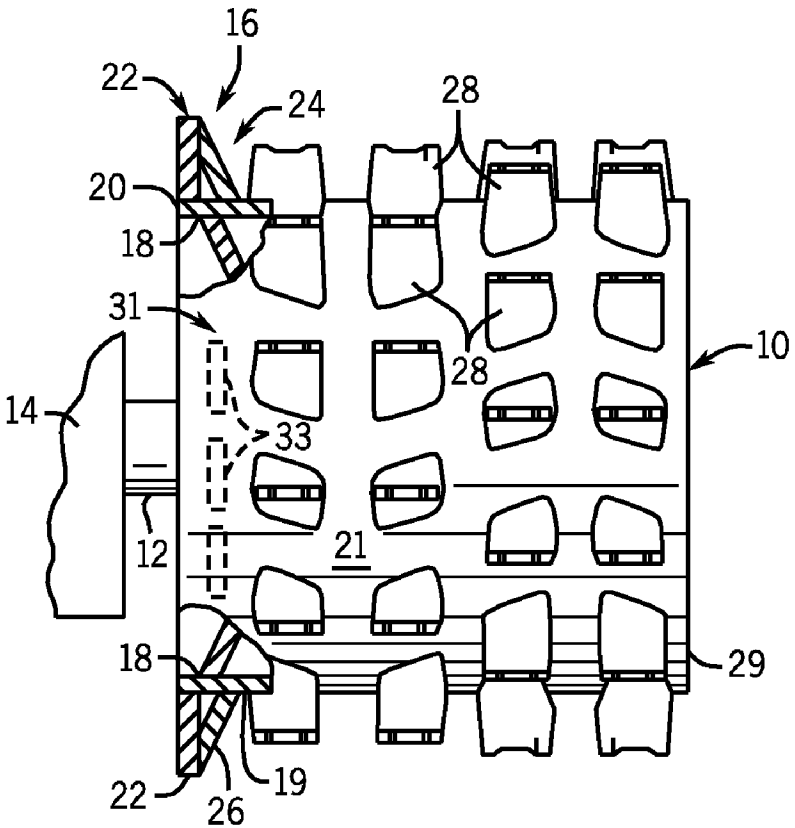
FIG. 2 is a front view of a compactor wheel having a modular axle guard mounted thereon according to an embodiment of the invention.

Referring to FIGS. 1-3, a compactor wheel 10 according to one embodiment of the present invention is shown mounted on the axle 12 of a compaction machine 14. The present invention is not intended to be limited to any particular type of compaction machine and may be used on any suitable compaction machine. The wheel 10 includes a hub 11 adapted, for example, with a plurality of bolt holes for being bolted or otherwise mounted to the axle 12. A rim 18 is mounted around the hub 11. The rim 18 includes a wrapper 19 with an outer face or surface 21 on which a plurality of cleats 28 are mounted, such as by welding or any other suitable technique.

The wheel 10 also includes a modular axle guard 16 that forms a circumferential barrier which extends radially out from the wrapper 19 of rim 18. The modular axle guard 16 extends radially out from the rim 18 to a height above, equal to, or below the cleats 28 mounted on wrapper 19, according to embodiments of the invention. It is believed that desirable results may be obtained using an axle guard 16 having a height in the range of about 1 inch to about 10 inches and a thickness of up to 2 inches.

The modular axle guard 16 is positioned on wrapper 19 near the inner circumferential edge 20 of the wheel 10. According to an exemplary embodiment, axle guard 16 is positioned adjacent the inner circumferential edge 20 of the wheel 10 (i.e., on the inner circumferential edge); however, it is recognized that in being positioned "near" the inner circumferential edge 20, modular axle guard 16 may be positioned on wrapper 19 in any location that is nearer to inner circumferential edge 20 than to an outer circumferential edge 29 of wheel 10, such as being positioned up to 10 inches outward from the inner circumferential edge 20. Thus, in being positioned "near" the inner circumferential edge 20, modular axle guard 16 is not limited to being placed at a specific location on wrapper 19.

With respect to the positioning of modular axle guard 16 "near" the inner circumferential edge 20, it is further recognized that positioning of modular axle guard 16 "near" circumferential edge 20 encompasses positioning of the modular axle guard in a cleat free area 31 of wrapper 19. The cleat free area 31 is understood to be an area on wrapper 19 completely devoid of cleats 28 thereon, or may also be understood as an area on wrapper 19 where cleats 33 (shown in phantom in FIG. 2) are arranged in a direction substantially parallel to a direction of travel of compaction machine 14. That is, a majority of cleats 28 formed on wrapper 19 are arranged substantially parallel to axle 12 and perpendicular to a direction of travel of compaction machine 14. Cleats 33 (i.e., "longitudinal cleats) present in cleat free area 31, however, are arranged substantially perpendicular to axle 12 and parallel to a direction of travel of compaction machine 14. Such cleats 33 in cleat free area 31 do not function to compact trash or provide traction such as those cleats 28 arranged perpendicular to a direction of travel of compaction machine 14, and thus cleats 33 can be understood to be included in what is considered a "cleat free area."

As shown in FIG. 2, the modular axle guard 16 is mounted circumferentially around the wrapper 19 of rim 18 and is supported or reinforced by a buttressing structure 24 to, for example, help prevent the axle guard 16 from being bent or knocked off during the operation of the compactor wheel 10. The need for such a buttressing structure 24 reduces, for example, as the height of the axle guard 16 decreases. The need for a buttress 24 also reduces, for example, as the thickness of the barrier axle guard increases. According to an exemplary embodiment, the buttressing structure 24 is a structure separate from the modular axle guard 16 such as, for example, a series of blocks or plates 26 spaced circumferentially around the wrapper 19. Each of these blocks or plates 26 is mounted to the surface 21 of the wrapper 19 along a lower circumferential edge and to the modular axle guard 16 along an upper circumferential edge, such as by welding, bolting or any other suitable technique. The buttressing structure 24 can also be any other continuous structure, such as a cone-shaped structure that provides the axle guard 16 with the desired degree of support.

Modular axle guard 16 helps to prevent cable, rope, wire and other refuse and debris from moving inward toward the inner edge 20 of the compactor wheel 10 and subsequently wrapping around the axle 12 of compaction machine 14. Additionally, the modular axle guard 16 can cut a line in the trash being compacted which gives the operator of the compaction machine 14 an indication of where the last pass was made by the machine 14, thereby helping to ensure that each area of the landfill will be subjected to the same number of passes and to achieve complete compaction coverage. Furthermore, having modular axle guard 16 extend radially out from the wrapper 19 helps to stabilize the compaction machine 14 as it moves across a sloped portion of the landfill.

Figure 4:
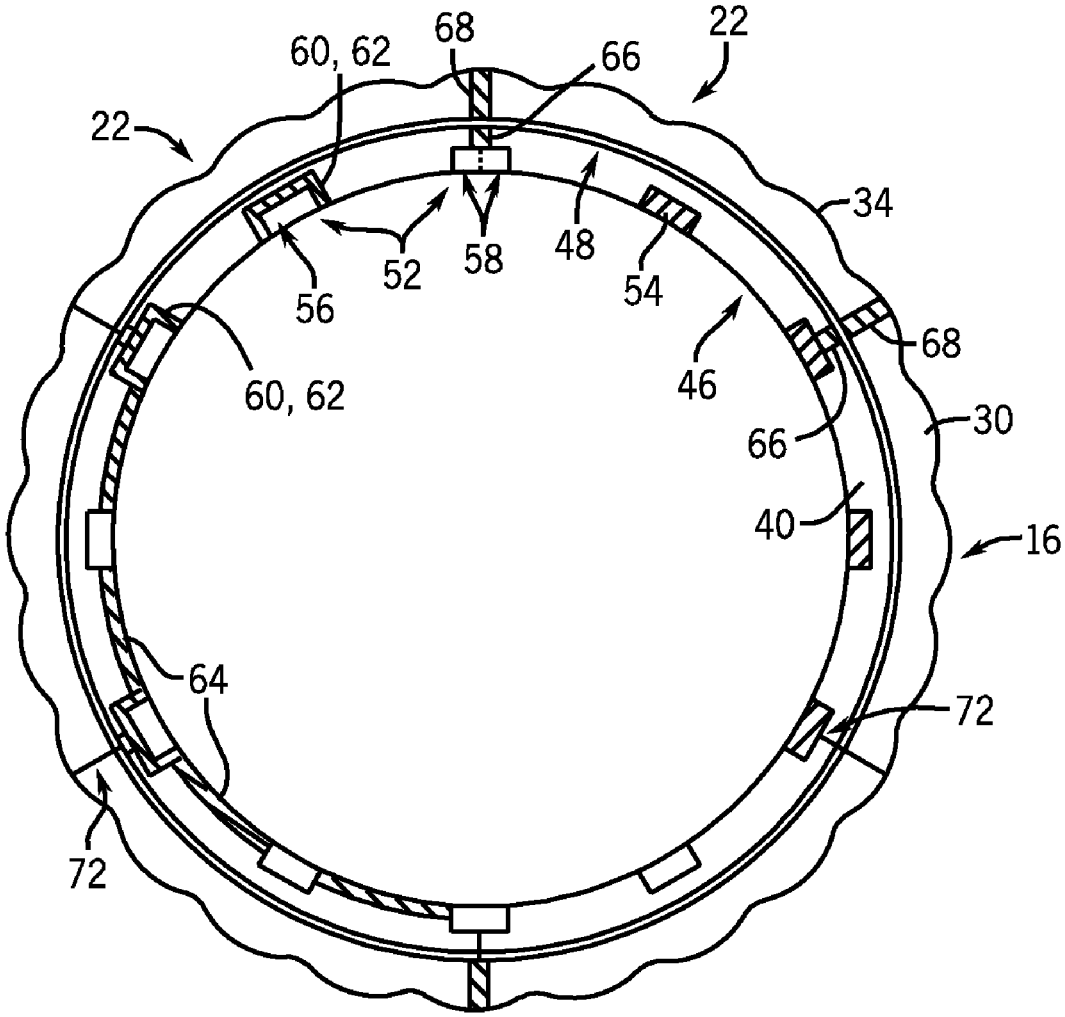
FIG. 4 is an inner edge view of the compactor wheel of FIG. 2 with the modular axle guard mounted thereon according to an embodiment of the invention.
Figure 5:
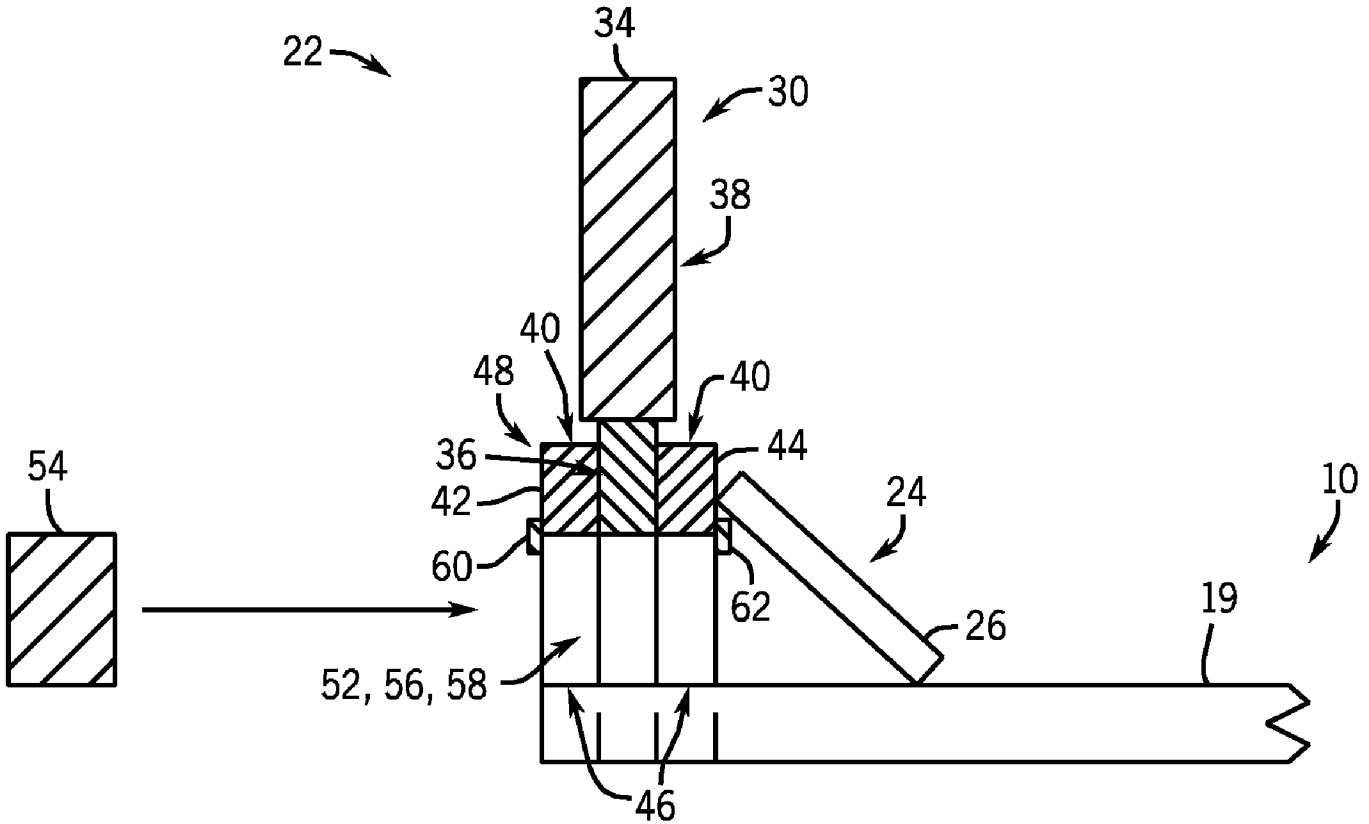
FIG. 5 is a cross-sectional, detailed view of a guard module according to an embodiment of the invention.

Referring now to FIGS. 4 and 5, plan and cross-sectional views of modular axle guard 16 are shown according to an embodiment of the invention. Modular axle guard 16 includes a plurality of guard modules 22 that make up the axle guard system. Each guard module 22 further includes guard segments 30, such as plate-type barriers or fins, that are secured to one another from end to end so as to encircle wrapper 19. Each of guard segments 30 includes an abutment edge 32 that is profiled to correspond with a curvature of the wrapper 19 and an outer edge 34 having a desired profile. The profile of outer edge 34 may be a wave-shaped profile according to an embodiment of the invention, but it is recognized that other suitable profiles could also be implemented. Each guard segment 30 includes a first portion 36 adjacent to abutment edge 32 and a second portion 38 adjacent outer edge 34, with second portion 38 having an increased thickness as compared to first portion 36. When positioned about wrapper 19, the plurality of guard segments 30 form a ring-shaped barrier that encircles the wheel 10 to prevent wire from wrapping around axle 12 (FIG. 2).

Referring still to FIGS. 4 and 5, each guard module 22 also includes therein a plurality of wedge segments 40. The wedge segments 40 include an inner wedge segment 42 and an outer wedge segment 44 that are placed on opposing sides of a respective guard segment 30 to provide buttressing and support thereto. Specifically, as shown in FIG. 5, inner wedge segment 42 is placed adjacent inner edge 20 of rim 18 and on one side of first portion 36 of guard segment 30, while outer wedge segment 44 is placed on an opposing side of first portion 36. As such, inner wedge segment 42 and outer wedge segment 44 are positioned in a spaced apart relationship, so as to form a groove therebetween in which guard segment 30 is seated (i.e., first portion 36 of guard segment). As set forth above, first portion 36 of guard segment 30 has a decreased thickness as compared to second portion 38, such that wedge segments 40 are placed partially beneath second portion 38 to provide support thereto. Each of wedge segments 40 includes an abutment edge 46 that is profiled to correspond with a curvature of wrapper 19 and a mating edge 48 that is profiled to correspond with a curvature of a bottom surface of second portion 38. In another embodiment of the invention, inner wedge segment 42 is positioned flush against a inner edge of wrapper 19 rather than on top of wrapper 19. In such an embodiment, abutment edge 46 of inner wedge segment 42 could be formed to have a slightly modified curvature.

The abutment edge 32 of guard segment 30 and the abutment edge 46 of wedge segments 40 are each formed to include a plurality of notches 52 therein that are sized to receive welding blocks 54 or welding elements therein. According to one embodiment, a full-sized notch 56 is formed in a central location of guard segment 30 and wedge segments 40 along abutment edge 30, 46 and partial notches 58 are formed at opposing ends of the abutment edge 30, 46. The partial notches 58 formed at the ends of the abutment edge 30, 46 match up with partial notches 58 formed at the ends of the abutment edge 30, 46 on adjacent guard segments 30 and wedge segments 40, such that the a pair of partial notches 58 form a full-sized notch configured to receive a block 54 therein. According to an exemplary embodiment, the partial notches 58 are all formed as half notches, although it is recognized that the partial notches 58 could be formed as quarter and three-quarter notches that could match up with quarter and three-quarter notches of adjacent guard segments 30 to form full-sized notches.

The welding blocks 54 are sized so as to be insertable within notches 52 of guard segment 30 and wedge segments 40 and function to affix wedge segments 40 to wrapper 19 and secure guard segment 30 relative to wedge segments 40. According to an embodiment of the invention, a welding block 54 is positioned in respective notches 52 of inner wedge segment 42, guard segment 30, and outer wedge segment 44. Block 54 is affixed to the inner wedge segment 42, the wrapper 19, and the outer wedge segment 44 by way of welds 60, 62.

Additional welds 64, 66, 68 are also formed on modular axle guard 16 to secure wedge segments 40 to wrapper 19 and affix adjacent guard segments 30 to one another. In particular, a weld 64 is formed between each of inner and outer wedge segments 42, 44 and wrapper 19 to secure the wedge segments to the rim 18 of wheel 10. Also, a weld 66 is formed between side edges 70 of adjacent wedge segments 40 to affix the adjacent wedge segments to one another. To secure guard segments 30, a weld 68 is formed between side edges 72 of adjacent guard segments 30, thereby securing each of the guard segments to one another. Welds 60-68 thus secure each guard module 22 to rim of wheel 19 and also to adjacent guard modules 22.

It is recognized that, over time, wear and/or structural deficiencies may be become present in a guard segment 30 and that a guard segment may therefore need to be replaced. The use of individual guard modules 22 in assembling modular axle guard 16 allows for the selective replacement of a desired guard segment 30 as needed. In replacing a desired guard segment 30, the welds 68 formed between side edges 70 of adjacent guard segments 30 are broken. The breaking of welds 68 allows for removal of the broken guard segment 30 from guard module 22, while allowing the wedge segments 40 to remain affixed to wrapper 19 of wheel 10. A replacement guard segment 30 can then be inserted between inner and outer wedge segments 42, 44 such that the notches 52 in the guard segment 30 are aligned with blocks 54 that remain welded to the wedge segments 42, 44 and wrapper 19. The replacement guard segment 30 is then affixed to adjacent guard segments 30 by way of forming new welds 68 between side edges 70 of the replacement guard segment and respective side edges 70 of the adjacent guard segments 30.

In addition to allowing for the selective replacement of individual guard segments 30, the incorporation of separate guard segments 30, wedge segments 40, and blocks 54 in each guard module 22 also allows for the guard module 22 to have a hybrid construction. That is, according to an exemplary embodiment of the invention, each guard module 22 is formed in a hybrid construction from a plurality of materials. Guard segments 30 are formed of a high strength, abrasion resistant material, while the wedge segments 40 and blocks 54 are formed of a cheaper, lower-grade steel. Beneficially, the hybrid construction of guard modules 22 allows for savings in materials to be realized, while still providing the modular axle guard 16 with desired strength and abrasion-resistant qualities, as well as providing improved welding characteristics between guard module 22 and wrapper 19 (i.e., welding of wedge segments 40 and blocks 54 to wrapper 19).

It is recognized that, with respect to FIG. 4, only a portion of the welding blocks 54 and welds 60, 62, 64, 66, 68 used for assembling/forming modular axle guard 16 are shown. That is, each of guard modules 22 would implement welding blocks 54 and welds 60, 62, 64, 66, 68 for securing segments 40 to wrapper 19 and affixing adjacent guard segments 30 to one another.

Figure 6:
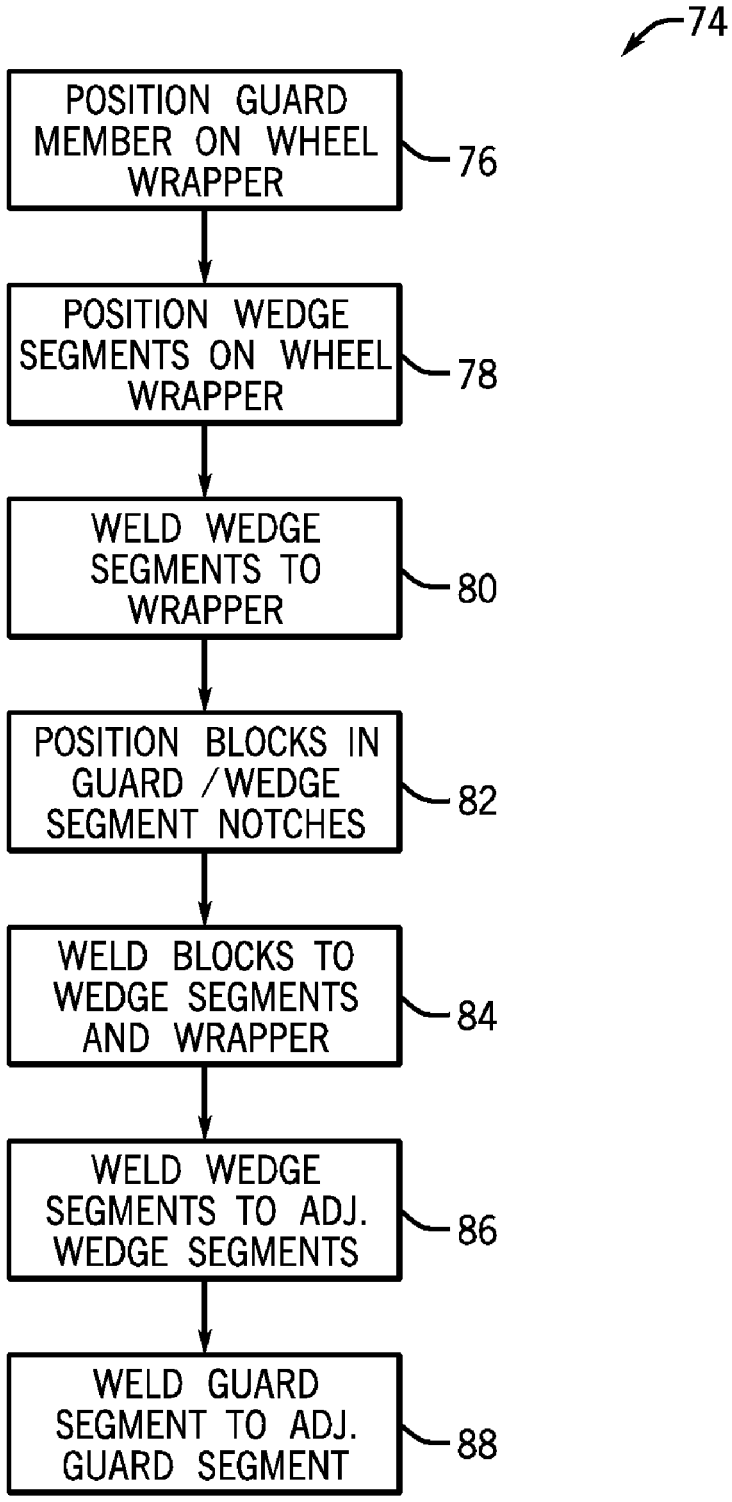
FIG. 6 is a flow chart showing a process for mounting a guard module on a compactor wheel according to an embodiment of the invention.

Referring now to FIG. 6, and with continued reference to FIGS. 4 and 5, a method 74 for assembling guard modules 22 of modular axle guard 16 on a compactor wheel 10 is shown. In assembling each guard module 22 in modular axle guard 16, a guard segment 30 is first placed on wrapper 19 of wheel 10 at a location adjacent inner periphery 20 at STEP 76. The guard segment 30 can be secured to wrapper 19 in a desired orientation by way of clamps for example. Upon placement of the guard segment 30, wedge segments 40 are then placed on wrapper 19 of wheel 10 on either side of the guard segment at STEP 78, and are secured to the rim (and to guard segment 30)

by way of clamps. In placing the wedge segments 40, the inner and outer wedge segments 42, 44 are positioned such that the notches 52 formed therein are aligned with the notches 52 formed in guard segment 30.

In a next step of the method 74, the abutment edge 46 of the wedge segments 40 are welded to wrapper 19 of rim 18 at STEP 80 to secure the wedge segments 40 to the wheel 10. Upon welding of the wedge segments 40 to the wrapper 19, welding blocks 54 are provided and positioned within notches 52 of the wedge segments 40 and the guard segment 30 at STEP 82. According to an exemplary embodiment, a single welding block 54 is passed through respective notches 52 of the inner wedge segment 42, the guard segment 30, and the outer wedge segment 44. Upon placement of the blocks 54 in notches 52, the blocks 54 are welded to the inner and outer wedge segments 42, 44 and to the wrapper 19 at STEP 84, such as by plug welding, for example. Welding of the block 54 to wedge segments 40 and wrapper 19 thus further affixes wedge segments 40 to wrapper 19, and also secures guard segment 30 relative to the wedge segments 40 by positioning block 54 within notch 52 of the guard segment.

To further secure wedge segments 40 and guard segment 30, additional welds are formed at STEPS 86 and 88. Specifically, at STEP 86, opposing side edges 68 of the wedge segments 40 are welded to the side edges of respective adjacent wedge segments. At STEP 88, opposing side edges 70 of the guard segment 30 are welded to the side edges of respective adjacent guard segments. By welding side edges 70 of each guard segment 30 to the side edges of respective adjacent guard segments, a singular guard segment encircling wheel 10 can be formed. The singular guard segment in modular axle guard 16 thus is secured about the wheel 10 based on the welding of adjacent guard segments 30 to one another, and is secured relative to wedge segments 40.

Figure 7:
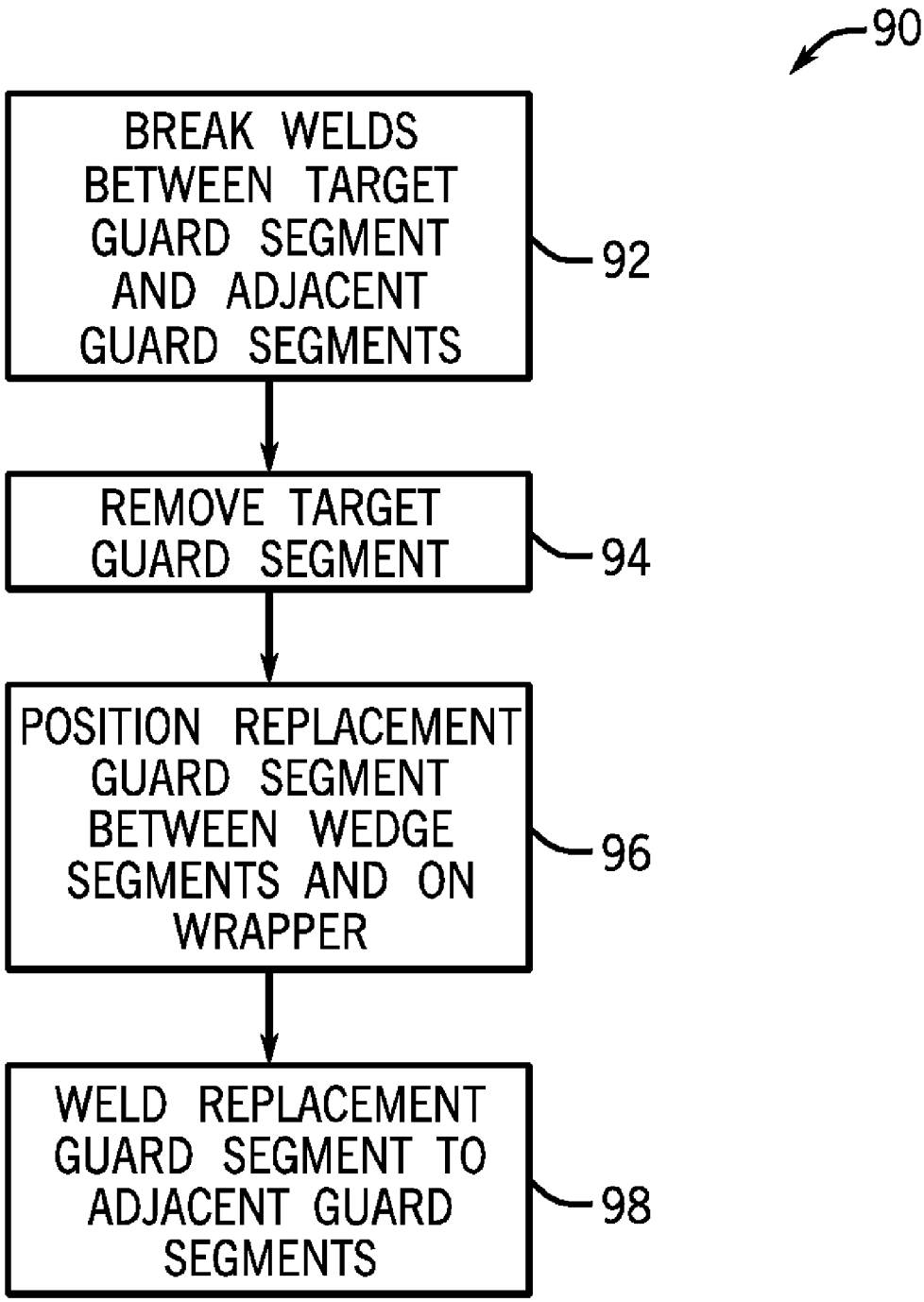
FIG. 7 is a flow chart showing a process for replacing a worn guard module on a compactor wheel according to an embodiment of the invention.

The securing of each guard segment 30 relative to the wheel 10, based on its welding to adjacent guard segments 30 and based on its positioning between wedge segments 40 and relative to blocks 54, provides for a guard segment that is easily removable when desired. That is, as set forth above, it is recognized that wear and/or structural deficiencies may be become present on individual guard segments 30 in modular axle guard 16 and that it thus may be desirable for an individual guard segment 30 to be selectively removed without a requirement for removing the entire modular axle guard 16, or even an entire respective guard module 22. Referring now to FIG. 7, a method 90 is shown for removing an existing guard segment 30 that may have become damaged/worn during use. As STEP 92, the welds 68 formed between the side edges 70 of the target guard segment 30 (i.e., the worn/defective guard segment) and the side edges 70 of adjacent guard segments 30 are broken. The welds 68 can be broken in any of several known manners, such as by way of an angle or die grinder or by way of a cut-off wheel. Upon the breaking of welds 68, the target guard segment 30 is released from guard module 22 (as it is not welded to wrapper 19, wedge segments 40, or block 54) can be removed from the guard module at STEP 94, while allowing the wedge segments 40 to remain affixed to wrapper 19 of wheel 10. A replacement guard segment 30 can then be inserted between inner and outer wedge segments 42, 44 at STEP 96 such that the notches 52 in the guard segment 30 are aligned with blocks 54 that have remained welded to the wedge segments 40 and wrapper 19. The replacement guard segment 30 is then secured to adjacent guard segments 30 at STEP 98 by welding the side edges 70 of the replacement guard segment 30 to respective side edges 70 of adjacent guard segments 30. Thus, according to the method of FIG. 7, a worn guard segment 30 is easily replaceable at a minimal cost, while allowing for the remainder of an existing modular axle guard 16 to remain in place.

Figure 8:
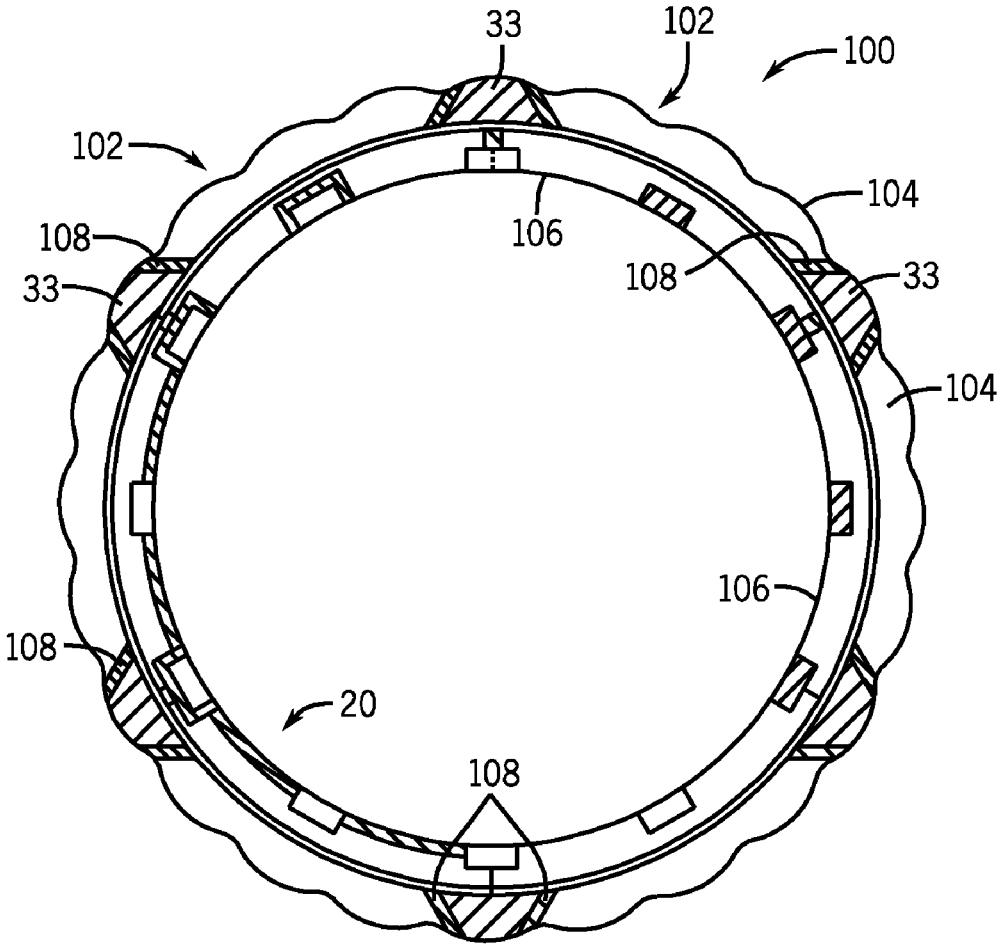
FIG. 8 is an inner edge view of the compactor wheel of FIG. 2 with a modular axle guard mounted thereon according to another embodiment of the invention.

Referring now to FIG. 8, a modular axle guard 100 is shown according to another embodiment of the invention. The modular axle guard 100 is configured to be mounted on a compactor wheel 10 that includes that includes a plurality of cleats 33 positioned thereon adjacent to inner circumferential edge 20, with the cleats 33 being arranged in a direction substantially parallel to a direction of travel of compaction machine 14 (FIG. 1). The modular axle guard 100 includes a plurality of guard modules 102 that make up the axle guard system. Each guard module 102 further includes guard segments 104, such as plate-type barriers or fins, that are secured between adjacent cleats 33 so as to encircle wrapper 19 (FIG. 2). Each of guard modules 102 also includes therein a plurality of wedge segments 106. The wedge segments 106 include an inner wedge segment and an outer wedge segment (not shown) that are placed on opposing sides of a respective guard segment 104, so as to form a groove therebetween in which guard segment 104 is seated.

As opposed to modular axle guard 16 shown and described in FIGS. 4 and 5, the guard modules 102 of modular axle guard 100 are secured to cleats 33 rather than to adjacent guard modules. That is, rather than forming a weld between adjacent guard segments 104 (as described with respect to guard segments 30 of FIGS. 4 and 5), guard segments 104 are secured between adjacent pairs of cleats 33 by way of welds 108. The securing of each guard segment 104 relative to the wheel 10, based on its welding to cleats 33 and based on its positioning between wedge segments 104, provides for a guard segment that is easily removable when desired. That is, as set forth above, it is recognized that wear and/or structural deficiencies may be become present on individual guard segments 104 in modular axle guard 100 and that it thus may be desirable for an individual guard segment 104 to be selectively removed without a requirement for removing the entire modular axle guard 100, or even an entire respective guard module 102. In replacing a desired guard segment 104, the welds 108 formed between a guard segment 104 and adjacent cleats 33 are broken. The breaking of welds 108 allows for removal of the broken guard segment 104 from guard module 102, while allowing the wedge segments 104 to remain affixed to wrapper 19 of wheel 10 (FIG. 2). A replacement guard segment 104 can then be inserted between inner and outer wedge segments 106. The replacement guard segment 104 is then affixed to cleats 33 by way of forming new welds 108 between the replacement guard segment and cleats 33.

Therefore, according to one embodiment of the invention, a compactor wheel is provided that is mountable on an axle of a compaction machine. The compactor wheel includes a hub mountable to an axle of a compaction machine and a rim mounted around an outer circumference of the hub, with the rim having a wrapper, an inner circumferential edge, and an outer circumferential edge. The compactor wheel also includes a modular axle guard positioned near the inner circumferential edge and extending outward from the wrapper, with the modular axle guard having a plurality of guard modules arranged about an outer circumference of the rim. Each of the plurality of guard modules includes a pair of wedge segments affixed to the wrapper and positioned on the wrapper in a spaced apart relationship and a guard segment positioned on the wrapper and seated between the pair of wedge segments, with the guard segment including a portion that extends radially outward from the wrapper and beyond the pair of wedge segments.

According to another embodiment of the invention, a method is provided for attaching each of a plurality of guard modules to a compactor wheel that includes a rim having a wrapper, an inner circumferential edge, and an outer circumferential edge. The method includes the step of positioning a guard segment on the wrapper near to the inner circumferential edge of the rim and between an inner wedge segment and an outer wedge segment affixed on the wrapper and such that a first portion of the guard segment is seated between the inner wedge segment and the outer wedge segment and a second portion of the guard segment extends radially outward past the inner and outer wedge segments. The method also includes the step of affixing opposing edges of the second portion of the guard segment to the second portion of guard segments in adjacent guard modules.

According to yet another embodiment of the invention, a modular axle guard is provided that is formed about a rim of a compactor wheel. The modular axle guard includes a plurality of guard modules arranged circumferentially about the rim of the compactor wheel and in proximity to an inner edge thereof. Each of the plurality of guard modules includes a pair of wedge segments positioned on a wrapper of the rim in a spaced apart relationship to form a groove between the pair of wedge segments, with each of the pair of wedge segments having an abutment edge having a profile corresponding to a curvature of the wrapper. Each of the plurality of guard modules also includes a guard segment positioned on the wrapper and including a first portion positioned adjacent the rim and a second portion extending radially outward from the first portion, wherein the first portion is seated in the groove between the pair of wedge segments. Each of the plurality of guard modules further includes a first group of welds configured to affix the pair of wedge segments to the wrapper and a second group of welds configured to affix the second portion of the guard segment to the second portion of guard segments from adjacent guard modules.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compactor wheel mountable on an axle of a compaction machine, the compactor wheel comprising:

a hub mountable to an axle of a compaction machine;

a rim mounted around an outer circumference of the hub, the rim having a wrapper, an inner circumferential edge, and an outer circumferential edge; and a modular axle guard positioned near the inner circumferential edge and extending outward from the wrapper, the modular axle guard comprising a plurality of guard modules arranged about an outer circumference of the rim, and wherein each of the plurality of guard modules comprises:

a pair of wedge segments positioned on the wrapper in a spaced apart relationship, the pair of wedge segments being affixed to the wrapper; and a guard segment positioned on the wrapper and seated between the pair of wedge segments, the guard segment including a portion that extends radially outward from the wrapper and beyond the pair of wedge segments.

2. The compactor wheel of claim 1 wherein each of the pair of wedge segments and the guard segment includes an abutment edge having a profile that corresponds with a curvature of the wrapper; and wherein each of the pair of wedge segments and the guard segment includes a plurality of notches formed therein along the abutment edge.

3. The compactor wheel of claim 2 wherein the plurality of notches comprises:

a full notch positioned in a central area of the pair of wedge segments and the guard segment along the abutment edge;

and a partial notch positioned on each end of the pair of wedge segments and the guard segment along the abutment edge.

4. The compactor wheel of claim 2 wherein each of the plurality of guard modules comprises a plurality of blocks sized to fit within respective notches formed in the pair of wedge segments and the guard segment.

5. The compactor wheel of claim 4 wherein each of the plurality of guard modules comprises a first weld group to affix the plurality of blocks to the pair of wedge segments and to the wrapper.

6. The compactor wheel of claim 5 wherein the first weld group further comprises welds formed between the abutment edge of each of the pair of wedge segments and the wrapper.

7. The compactor wheel of claim 1 wherein the portion of the guard segment extending radially outward beyond the pair of wedge segments is affixed to guard segments from adjacent guard modules.

8. The compactor wheel of claim 7 wherein each of the plurality of guard modules comprises a second weld group formed between each adjacent pair of guard segments in the modular axle guard, the second weld group being formed on the portion of the guard segment extending radially outward beyond the pair of wedge segments.

9. The compactor wheel of claim 1 wherein the guard segment comprises:

a first portion seated between the pair of wedge segments; and a second portion extending radially outward from the first portion and beyond the pair of wedge segments;

wherein the second portion has a thickness greater than a thickness of the first portion.

10. The compactor wheel of claim 9 wherein the first section is formed of abrasion resistant steel.

11. The compactor wheel of claim 1 further comprising a buttressing structure positioned adjacent the modular axle guard and configured to provide support to the guard segment and the pair of wedge segments.

12. The compactor wheel of claim 1 further comprising a plurality of longitudinal cleats affixed to the wrapper and positioned adjacent the inner circumferential edge; and wherein, for a respective guard module, the portion of the guard segment extending radially outward beyond the pair of wedge segments is affixed at opposing ends to respective longitudinal cleats positioned on both sides thereof.

13. A method for attaching each of a plurality of guard modules to a compactor wheel including a rim having a wrapper, an inner circumferential edge, and an outer circumferential edge, the method comprising:

positioning a guard segment on the wrapper near to the inner circumferential edge of the rim and between an inner wedge segment and an outer wedge segment affixed on the wrapper, wherein a first portion of the guard segment is seated between the inner wedge segment and the outer wedge segment and a second portion of the guard segment extends radially outward past the inner and outer wedge segments; and affixing opposing edges of the second portion of the guard segment to the second portion of guard segments in adjacent guard modules.

14. The method of claim 13 further comprising:

positioning the inner wedge segment and the outer wedge segment on the wrapper and on opposing sides of the guard segment; and affixing each of the inner wedge segment and the outer wedge segment to the wrapper.

15. The method of claim 14 wherein the guard segment, the inner wedge segment, and the outer wedge segment have a plurality of notches formed therein along an abutment surface adjacent the wrapper, and further comprising:

aligning the plurality of notches formed in the guard segment with the plurality of notches formed in the inner wedge segment and the outer wedge segment; and positioning a welding block in each of the plurality of notches such that the welding block extends through a respective notch formed in each of the guard segment, the inner wedge segment, and the outer wedge segment.

16. The method of claim 15 wherein affixing the inner wedge segment and the outer wedge segment to the wrapper comprises:

welding the abutment surface of the inner and outer wedge segments to the wrapper;

welding a first end of a respective welding block to the inner wedge segment and the wrapper; and welding a second end of the respective welding block to the outer wedge segment and the wrapper.

17. The method of claim 13 wherein affixing opposing edges of the second portion comprises welding opposing edges of the second portion of the guard segment to edges of guard segments in adjacent guard modules.

18. A modular axle guard formed about a rim of a compactor wheel, the modular axle guard comprising:

a plurality of guard modules arranged circumferentially about the rim of the compactor wheel and in proximity to an inner edge thereof, each of the plurality of guard modules comprising:

a pair of wedge segments positioned on a wrapper of the rim in a spaced apart relationship to form a groove between the pair of wedge segments, each of the pair of wedge segments having an abutment edge having a profile corresponding to a curvature of the wrapper;

a guard segment positioned on the wrapper and including a first portion positioned adjacent the rim and a second portion extending radially outward from the first portion, wherein the first portion is seated in the groove between the pair of wedge segments;

a first group of welds configured to affix the pair of wedge segments to the wrapper; and a second group of welds configured to affix the second portion of the guard segment to the second portion of guard segments from adjacent guard modules.

19. The modular axle guard of claim 18 wherein each of the pair of wedge segments and the guard segment includes a plurality of notches formed therein; and wherein the guard module further comprises a plurality of blocks configured to mate with the plurality of notches formed in the pair of wedge segments and the guard segment.

20. The modular axle guard of claim 19 wherein the first group of welds comprises:

welds formed between the abutment edges of the pair of wedge segments and the wrapper; and welds formed between the plurality of blocks, the pair of wedge segments, and the wrapper.

21. The modular axle guard of claim 18 wherein the guard segment is unattached from the pair of wedge segments and from the wrapper.

22. The modular axle guard of claim 18 wherein the second portion of the guard segment has a thickness greater than a thickness of the first portion.

* * * * *